US007871021B2

(12) United States Patent
Cooke

(10) Patent No.: US 7,871,021 B2
(45) Date of Patent: Jan. 18, 2011

(54) INJECTION NOZZLE

(75) Inventor: Michael P. Cooke, Gillingham (GB)

(73) Assignee: Delphi Technologies Holding S.arl, Troy, MI (US)

( * ) Notice: Subject to any disclaimer, the term of this patent is extended or adjusted under 35 U.S.C. 154(b) by 746 days.

(21) Appl. No.: 11/484,504

(22) Filed: Jul. 11, 2006

(65) Prior Publication Data

US 2007/0023545 A1 Feb. 1, 2007

(30) Foreign Application Priority Data

Jul. 13, 2005 (EP) ..... 05254381

(51) Int. Cl.
*F02M 63/00* (2006.01)

(52) U.S. Cl. ..... 239/533.2; 239/102.2; 239/533.3; 239/533.12; 239/584

(58) Field of Classification Search ..... 239/102.2, 239/533.4, 533.8, 533.9, 533.11, 533.12, 239/585.5, 900, 5, 87, 533.2, 533.7, 584, 239/585.1–585.4

See application file for complete search history.

(56) References Cited

U.S. PATENT DOCUMENTS 4,382,554 A * 5/1983 Hofmann ..... 239/533.9
4,407,457 A * 10/1983 Seifert ..... 239/533.12
6,412,712 B1 * 7/2002 Buckley ..... 239/533.12
6,811,103 B2 * 11/2004 Gurich et al. ..... 239/533.2
7,159,799 B2 1/2007 Cooke
7,309,030 B2 12/2007 Cooke
7,404,526 B2 7/2008 Cooke et al.
2003/0025006 A1 * 2/2003 Scarbrough et al. .... 239/533.12
2007/0012798 A1 1/2007 Cooke

FOREIGN PATENT DOCUMENTS

EP 0054612 6/1982
EP 0878623 11/1998
EP 1069308 1/2001
EP 1526274 4/2005
WO 02/06665 1/2002
WO 2004/044414 5/2004

* cited by examiner

*Primary Examiner*—Jason J Boeckmann
(74) *Attorney, Agent, or Firm*—Thomas N. Twomey

(57) ABSTRACT

The invention relates to a fuel injection valve for internal combustion engines, comprising a valve body (1), with a drilling (3) embodied therein and defined at the combustion chamber end thereof by a conical valve seat (18) from which at least one injection opening (20) leads. A hollow valve needle (8) is arranged in the drilling (3) such as to be displaced longitudinally, comprising a valve sealing surface (35) at the end thereof facing the valve seat (18). A first sealing region (31; 34) and a second sealing region (32; 46; 48) are embodied on the valve sealing surface (35), whereby, on contact of the hollow valve needle (8) on the valve seat (18), the first sealing region (31; 34) provides a seal upstream of the at least one injection opening (20) and the second sealing region (32; 46; 48) downstream thereof.

21 Claims, 9 Drawing Sheets

A - A

INJECTION NOZZLE

TECHNICAL FIELD

The present invention relates to an injection nozzle for use in a fuel injector for an internal combustion engine. More particularly, although not exclusively, one aspect of the present invention relates to an injection nozzle for use in a compression ignition internal combustion engine in which at least one valve is operable to control the injection of fuel into a combustion space through one or more nozzle outlets.

BACKGROUND TO THE INVENTION

Due to increasingly stringent environmental regulations, a great deal of pressure is levied upon automotive manufacturers to reduce the level of vehicle exhaust emissions, for example, hydrocarbons, nitrogen oxides (NOx) and carbon monoxide. As is well known, an effective method of reducing exhaust emissions is to supply fuel to the combustion space at high injection pressures (around 2000 bar for example) and to adopt nozzle outlets of a small diameter in order to optimise the atomisation of fuel and so improve efficiency and reduce the levels of hydrocarbons in the exhaust gases. Although the above approach is effective at improving fuel efficiency and reducing harmful engine exhaust emissions, an associated drawback is that reducing nozzle outlet diameter conflicts against the requirement for high fuel injection flow rates at high engine loads and so can compromise vehicle performance.

So-called "variable orifice nozzles" (VONs) enable variation in the number of orifices (and therefore the total orifice area) used to inject fuel into the combustion space at different engine loads. Typically, such an injection nozzle has at least two sets of nozzle outlets with first and second valves being operable to control whether fuel injection occurs through only one of the sets of outlets or through both sets simultaneously. In a known injection nozzle of this type, as described in the Applicant's co-pending European patent application no. EP04250928, the fuel flow to a first (upper) set of nozzle outlets is controlled by an outer valve and the fuel flow to a second (lower) set of nozzle outlets is controlled by an inner valve. The inner valve is lifted by the outer valve only after the flow of fuel through the first set of nozzle outlets has reached a sufficient rate. An injection nozzle of this type enables selection of a small total nozzle outlet area in order to optimise engine emissions at relatively low engine loads. On the other hand, a large total nozzle outlet area may be selected so as to increase the total fuel flow at relatively high engine loads.

Although beneficial in many ways, such nozzles do have associated problems. For instance, if the valves do not lift with perfect concentricity, high side loads can be generated due to the hydraulic pressure being significantly lower on the side of the outer valve closest to the nozzle body. Under some conditions these side loads can be high enough to prevent the outer valve closing.

One aspect of the present invention relates to a variable orifice nozzle which aims to have the advantages of the above designs, but which serves to alleviate or overcome the aforementioned side load problem.

SUMMARY OF THE INVENTION

To this end, the invention resides in an injection nozzle for an internal combustion engine. The injection nozzle comprises: a nozzle body defining a seating surface and having a first nozzle outlet and an outer valve member received within the nozzle body and being engageable with an external seating defined by the seating surface so as to control fuel injection through the first nozzle outlet. The outer valve member is provided with a bore having an internal bore surface. An insert is received within the bore, defining an annular gap with the internal bore surface. The outer valve member is engageable with an internal seating defined by a surface of the insert to control fuel flow through the annular gap to the first nozzle outlet. The arrangement is such that the outer valve member is arranged to disengage with the external seating at the same time as it disengages with the internal seating such that the fuel which is to be ejected from the nozzle is always caused to flow simultaneously along: (a) a first path between the outer valve member and the external seating; and (b) a second path through the annular gap.

An injection nozzle having a combination of features as set out above has been found to provide particular benefits. For example, the outer valve member is provided with both an internal seating and an external seating, one defined being by the nozzle body and one being defined by the insert in the outer valve bore. By providing the insert to define the internal seating, there is no restriction on the seats being at different axial heights (as in the case where two external seats are provided), so that the internal and external seats can be provided at approximately the same, or similar, axial positions. This means that the vertical area of the valve member exposed to unequal side forces near the outlet is reduced. Furthermore, the external seating and the internal seating can be positioned along the axis of the nozzle body in approximate alignment, at least in circumstances in which the outer valve member is seated.

The insert may include a part-spherical head which spans the internal diameter of the bore to define the annular gap. Preferably, the internal seating is defined by a surface of the part-spherical head. The provision of the part-spherical head on the insert means that any misalignment at the internal seating for the valve member is accommodated by the head being able to move angularly about the centre of its sphere. As the internal seating can be located close to the centre of the sphere, any torque at the internal seating resisting the realignment is minimised.

In one embodiment, the injection nozzle includes a second nozzle outlet provided in the nozzle body, wherein the insert is an inner valve member which is slidable within the bore and engageable with the insert seating defined by the seating surface so as to control fuel injection through the second outlets.

Further, it is preferred for an annular member to be received within the bore so as to be engageable with the internal seating. It is envisaged that the annular member will be a separate component from the main body of the outer valve member. Alternatively, the outer valve member may be machined such that the annular member is formed integrally therewith.

The injection nozzle may further comprise a sleeve member that is coupled to the inner valve member, wherein the annular member is brought into engagement with the sleeve member when the outer valve member is moved axially through a distance that is greater than a predetermined distance so as to impart axial movement to the inner valve member also.

Preferably, the annular member and the sleeve member have opposed end faces which are spaced apart by the predetermined distance when the outer valve member and the inner valve member are seated against their respective seatings.

In one embodiment, an end face of the annular member that engages the internal seating is substantially flat. However, in some respects, it is beneficial for the end face of the annular member that engages the internal seating to be frusto-conical. A frusto-conical end face generates a distinct annular seating line against the flat upper face of the part-spherical head, which provides an improved seal that is more tolerant of flatness errors and less likely to trap dirt.

Further, it is preferred that inner valve member includes a valve stem, wherein the internal seating is defined by a shoulder between the part-spherical head and the valve stem.

In another embodiment of the invention, the insert does not take the form of a moveable valve member. Instead, the insert may remain engaged with the insert seating during all stages of nozzle operation.

Also in this embodiment, the outer valve member may include an annular member which is received within the bore of the outer valve member so as to be engageable with the internal seating.

Preferably, the nozzle body is provided with a vent passage through which fuel can escape in the event of fuel leakage past the insert seating.

In any embodiment of the invention, the injection nozzle may further comprise an arrangement for urging the insert against the insert seating. For instance, the arrangement for urging the insert against the insert seating may include at least one opening formed in the outer valve member which enables fuel to enter the bore, thereby to apply a hydraulic closing force to the insert. In addition, a spring may be provided to urge the insert against the insert seating.

The above described embodiments provide a fuel flow path past the external seating to the first outlet, and a supplementary flow path to the first outlet past the internal seating when the outer valve member is unseated. The supplementary flow path may include at least one channel provided on the insert.

In a second aspect, the invention resides in an injector for use in an internal combustion engine, wherein the injector includes an injection nozzle as described above and an actuator for operating the injection nozzle.

In order to optimise control over the volume of fuel that is delivered to the combustion chamber, it is preferred that the actuator is a piezoelectric actuator. However, another form of actuator could also be used, such as an electromagnetic actuator.

It will be appreciated that the preferred and/or optional features of the first aspect of the invention may be provided alone, or in appropriate combination, in the second aspect of the invention also.

BRIEF DESCRIPTION OF THE DRAWINGS

By way of example, the invention will now be described with reference to the accompanying drawings, in which.

DETAILED DESCRIPTION OF THE PREFERRED EMBODIMENTS

Figure 1:
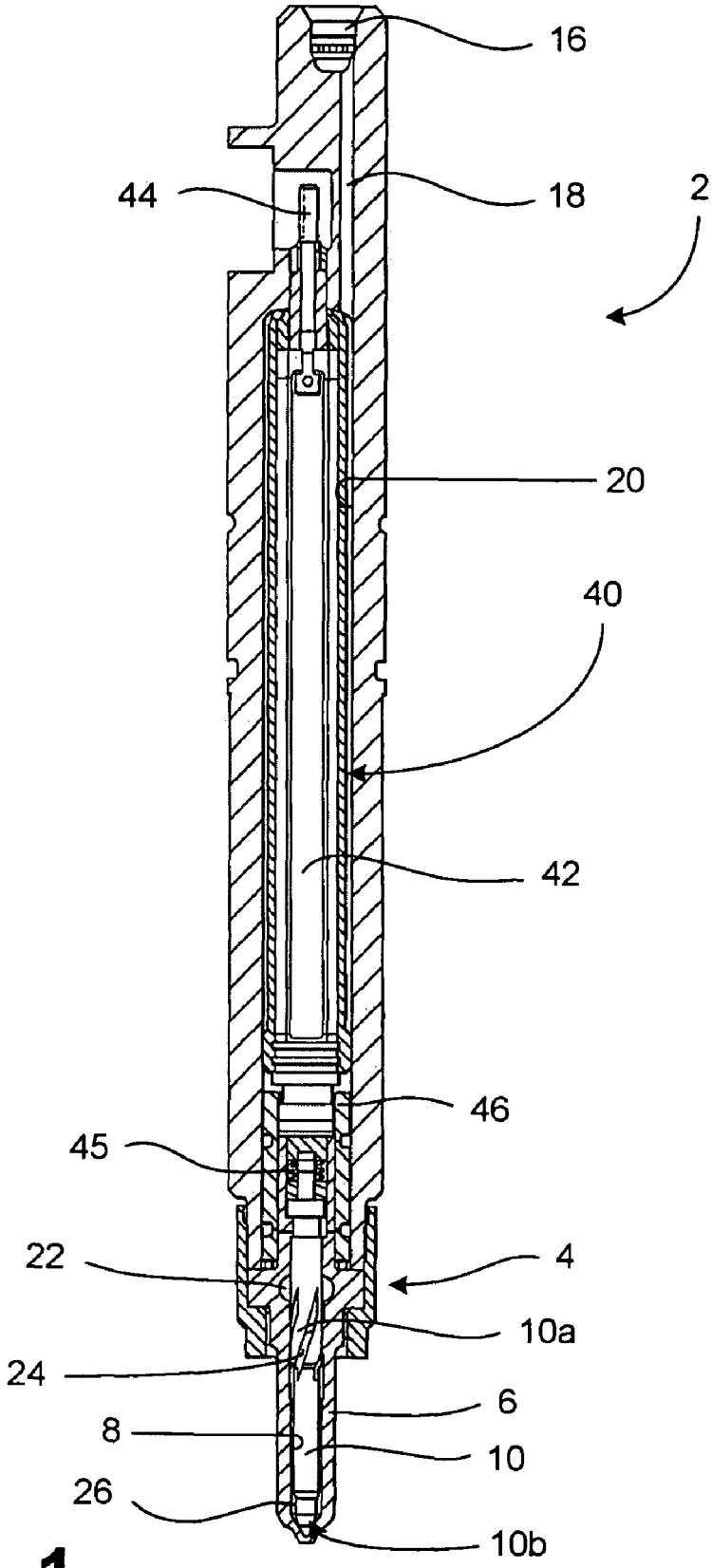
FIG. 1 is a part-sectional view of a fuel injector in which an injection nozzle in accordance with the embodiments of the present invention may be incorporated.

In the following description, the terms "upper" and "lower" are used having regard to the orientation of the injection nozzles as shown in the drawings. Likewise, the terms "upstream" and "downstream" are used with respect to the direction of fuel flow through the nozzle from a fuel inlet line to fuel outlets.

Figure 2:
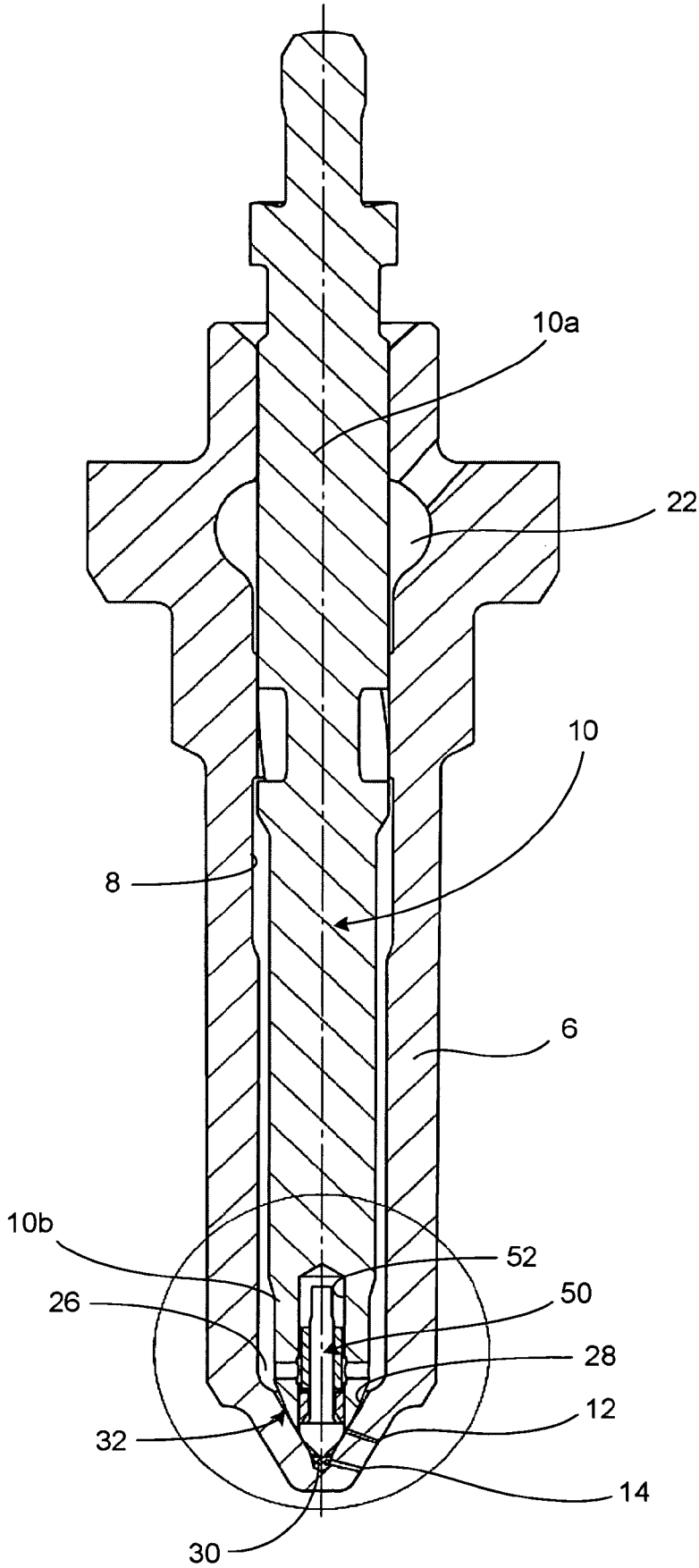
FIG. 2 is a part-sectional view of the injection nozzle according to a first embodiment of the invention when in a non-injecting position.

FIG. 1 shows a piezoelectric fuel injector, referred to generally as 2, within which an injection nozzle 4 in accordance with the invention is incorporated. FIG. 2 shows the injection nozzle in greater detail. The fuel injector 2 is of the type described in Applicant's U.S. Pat. No. 6,776,354.

The injection nozzle 4 includes a nozzle body 6 provided with an axial bore 8 within which an outer valve member 10 in the form of a needle is slidably received. The nozzle body 6 also includes respective first and second sets of nozzle outlets 12, 14 (not shown in FIG. 1) through which fuel can be injected into a combustion chamber, in use.

Fuel is supplied to the injector 2 via an injector inlet 16 from, for example, a common rail or other appropriate source of pressurised fuel, which is also arranged to supply fuel to one or more other injectors. Pressurised fuel is communicated from the inlet 16, through an inlet passage 18 and an accumulator volume 20, to an annular chamber 22 defined within the bore 8 between the nozzle body 6 and an upper end region 10*a* of the outer valve needle 10. The upper end region 10*a* has a diameter substantially equal to that of the nozzle body bore 8 such that, in use, co-operation between these parts serves to assist in guiding movement of the outer valve needle 10 as it reciprocates within the bore 8. Spiral flutes 24 machined into the upper region 10*a* provide a flow path for fuel to be communicated from the annular chamber 22, through the bore 8 and into a nozzle delivery chamber 26 located towards the tip of the outer valve needle 10. The delivery chamber 26 is defined between the outer surface of the outer valve needle 10 and the nozzle body bore 8 in a region upstream of the outlets 12, 14.

Towards its blind end, the nozzle body bore 8 defines a conical seating surface 28 that terminates in a sac volume 30. The seating surface 28 defines an external seat 32 with which a tip region 10*b* of the outer valve needle 10 is engageable to control fuel injection through the first set of nozzle outlets 12.

As shown in FIG. 1, movement of the outer valve needle 10 is controlled by means of a piezoelectric actuator 40. The piezoelectric actuator 40 comprises a stack 42 of piezoelectric elements, arranged within the accumulator volume 20, and an electrical connector 44 which enables a voltage to be applied across the stack 42. In use, the accumulator volume 20 forms a part of a supply passage to the injection nozzle 4 and, as it is filled with high pressure fuel, applies a hydrostatic loading to the stack 42 which increases the operational efficiency of the stack 42. The piezoelectric actuator 40 is coupled to the outer valve needle 10 via a hydraulic amplifier arrangement 46 and movement of the outer valve needle 10 is controlled by varying the voltage applied to the stack 42 in order to cause the stack 42 to extend and contract. When the voltage across the stack 42 is reduced, the stack 42 contracts so as to reduce its length and therefore a retracting force is applied to the outer valve needle 10. Conversely, when the voltage is increased, the length of the stack 42 increases which applies a force urging the outer valve needle 10 into engagement with the seating surface 28.

The outer valve needle 10 is biased towards the external seat 32 by means of a resilient member in the form of a closing spring 45 (shown in FIG. 1 only), and is operable to move away from the external seat 32, against the force provided by the closing spring 45, by means of the actuator.

It should be mentioned at this point that although in FIG. 2 a single outlet is shown in each set of outlets 12, 14, typically each set 12, 14 will include a plurality of outlets. Therefore, for the purposes of this specification, reference to an 'outlet' should be taken to mean one or more outlets.

The injection nozzle 4 also includes an insert member 50 in the form of an inner valve needle which is slidably mounted within a blind axial bore 52 provided in the tip region 10*b* of the outer valve needle 10. The lower end of the nozzle is shown more clearly in FIG. 3.

Figure 3:
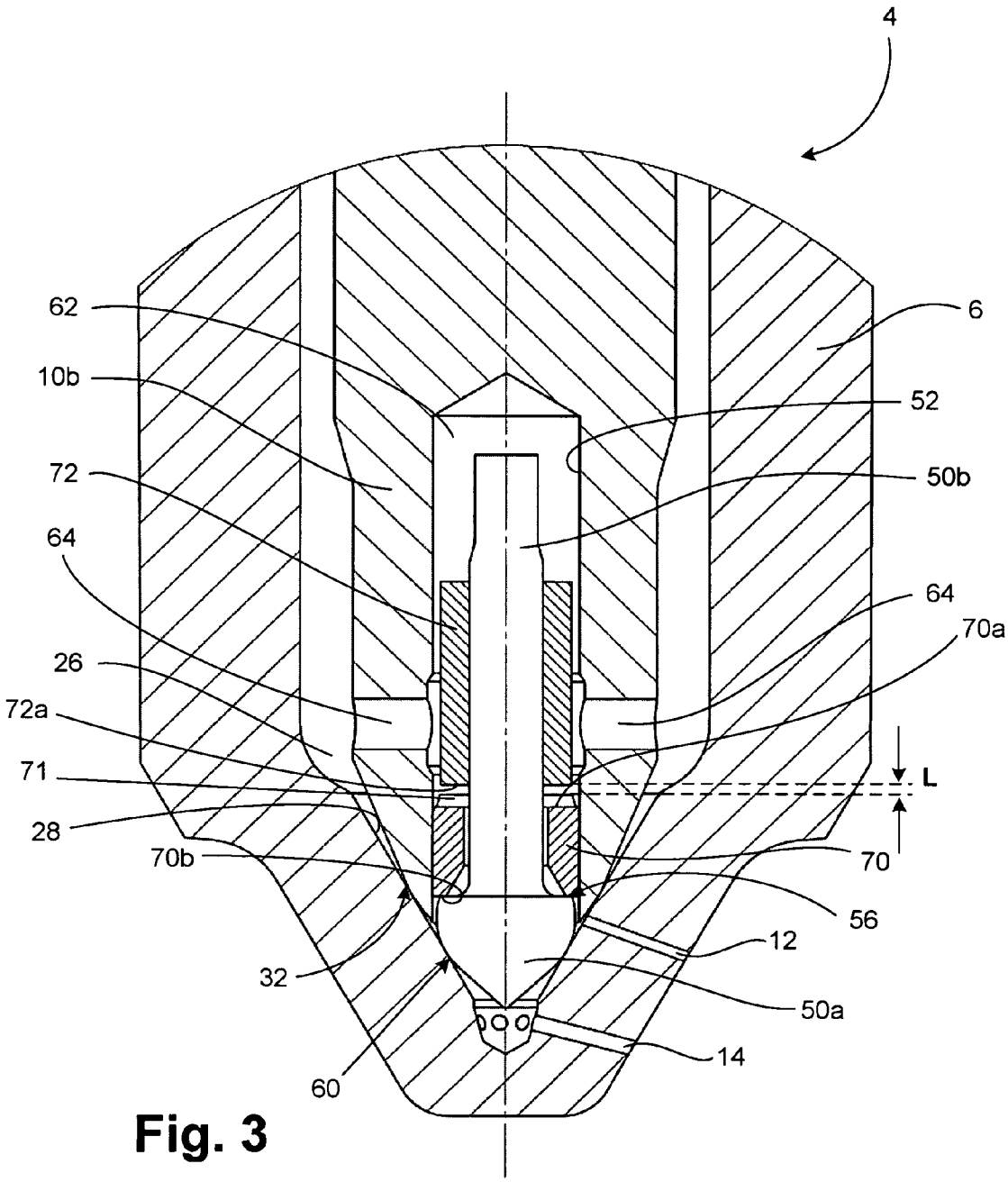
FIG. 3 is an enlarged part-sectional view of the injection nozzle in FIG. 2.

In FIG. 3, it can be seen that the inner valve needle 50 is shaped to include a part-spherical head 50*a* that tapers to a generally conical pointed tip. An upper stem region 50*b* extends upwardly from the part-spherical head 50*a* and is of generally uniform cross-section along its length having a diameter less than that of the head 50*a*.

At its widest point, where the part-spherical head 50*a* meets the stem 50*b*, the head 50*a* defines an upper surface that is received within the opening of the inner bore 52 and spans virtually the entire internal diameter thereof. However, the diameter of the part-spherical head 50*a* is slightly less than that of the outer valve bore 52 such that an annular gap 55 is defined between the periphery of the head 50*a* and the inward facing surface of the bore 52.

The upper surface of the part-spherical head 50*a* is substantially flat and defines a shoulder which provides an internal seating 56 for the outer valve needle 10. The outer valve needle 10 therefore has two seats i.e. the external seating 32 and the internal seating 56.

In the non-injecting position illustrated in FIGS. 2 and 3, the inner valve needle 50 is seated on an insert seating 60, referred to as the inner valve seating, which is defined by a region of the seating surface 28 at a position below the first outlets 12. Engagement between the part-spherical head 50*a* and the inner valve seating 60 thus controls fuel flow to the second outlets 14, whilst engagement between the outer valve needle 10 and the internal and external seats 56, 32 controls fuel flow to the first outlets 12.

The upper end of the stem region 50*b* is accommodated in a chamber 62 defined by the blind end of the outer valve bore 52. The chamber 62 is in communication with the nozzle body bore 8 via radial passages 64, in the form of cross drillings, provided in the outer valve needle 10 so that pressurised fuel within the nozzle body 8 is able to flow into the outer valve bore 52 and the chamber 62. Fuel pressure within the chamber 62 therefore acts on the inner valve needle 50 and so provides an arrangement for biasing the inner valve needle 50 against the inner valve seating 60.

As has been mentioned, movement of the inner valve needle 50 towards and away from the inner valve seating 60 controls fuel injection through the second set of outlets 14. However, unlike the outer valve needle 10, the inner valve needle 50 is not actuated directly by the piezoelectric stack 42. Instead, and as will be described in greater detail later, once the outer valve needle 10 has moved upwards (i.e. away from the external seating 32) beyond a pre-determined distance, it conveys movement to the inner valve needle 50 causing it to move upwards also away from the inner valve seating 60.

To this end, the outer valve needle 10 further comprises an annular member or ring 70 which is received within the outer valve bore 52. The ring 70 is a separate and distinct part and is coupled to the outer valve needle 10 through frictional contact between the outer surface of the ring 70 and the internal surface of the outer valve bore 52. That is to say, the ring 70 is an interference fit with the outer valve bore 52. Together, the outer valve needle 10 and the ring 70 form a moveable valve arrangement. The ring 70 includes a first, upper end face 70*a* and a second, lower end face 70*b*.

In the closed position, the lower end face 70*b* of the ring 70 engages the internal seating 56 defined by the upper face of the part-spherical head 50*a* such that the inner valve needle 50 is held against the inner valve seating 60 by virtue of the ring 70 acting in combination with high pressure fuel within the chamber 62. This is the position shown in FIG. 3.

The internal diameter of the ring 70 is greater than the outer diameter of the inner valve stem 50*b*, such that the stem 50*b* passes through the ring 70 and defines a clearance fit therewith such that fuel may flow past the clearance between the inner facing surface of the ring 70 and the outer facing surface of the stem region 50*b*. The upper face 70*a* of the ring 70 defines fuel channels 71 in the form of slots or grooves to allow fuel to pass into the centre of the ring 70, as will be described later.

In order for movement to be conveyed from the outer valve needle 10 to the inner valve needle 50, the stem region 50*b* carries a substantially tubular member 72 in the form of a sleeve, which is a separate and distinct part from the inner valve needle 50. The sleeve 72 has an external diameter that is less than the internal diameter of the outer valve bore 52, such that the inner valve needle 50 is free to slide within the bore 52. Further, the sleeve 72 has an internal diameter that is substantially equal to the outer diameter of the stem region 50*b* and, therefore, the sleeve 72 is an interference fit with the stem 50*b* and so is coupled to the stem 50*b* through frictional contact. A lower end face 72*a* of the sleeve 72 opposes the upper end face 70*a* of the ring 70, the purpose of which will now be described in further detail.

When both the outer valve needle 10 and the inner valve needle 50 are seated, the lower end face 72*a* of the sleeve 72 and the upper end face 70*a* of the ring 70 are separated by a distance 'L' that is predetermined at manufacture. The distance 'L' determines the amount by which it is necessary for the outer valve needle 10 to lift away from its internal and external seatings 56, 32 before engaging the sleeve 72 to convey movement to the inner valve needle 50. It should be appreciated that the lower end face 72*a* of the sleeve 72 and the upper end face 70*a* of the ring 70 are at maximum separation (i.e. predetermined distance 'L') when both the inner valve needle 50 and the outer valve needle 10 are seated, as shown in FIG. 3.

In use, fuel under high pressure is delivered from the common rail to the nozzle body bore 8 (and thus to the delivery chamber 26) via the inlet 16, the inlet passage 18 and the stack volume 20, as shown in FIG. 1. Initially, the piezoelectric actuator 40 is energised to a relatively high energisation level so that the stack 42 is in an extended state. In such circumstances, the outer valve needle 10 is held against its internal and external seatings 56, 32 due to the biasing force of the closing spring 45. The inner valve needle 50 is held against the inner valve seating 60 due to the pressure of the fuel within the chamber 62 and also by the ring 70 abutting the internal seating 56.

Figure 4:
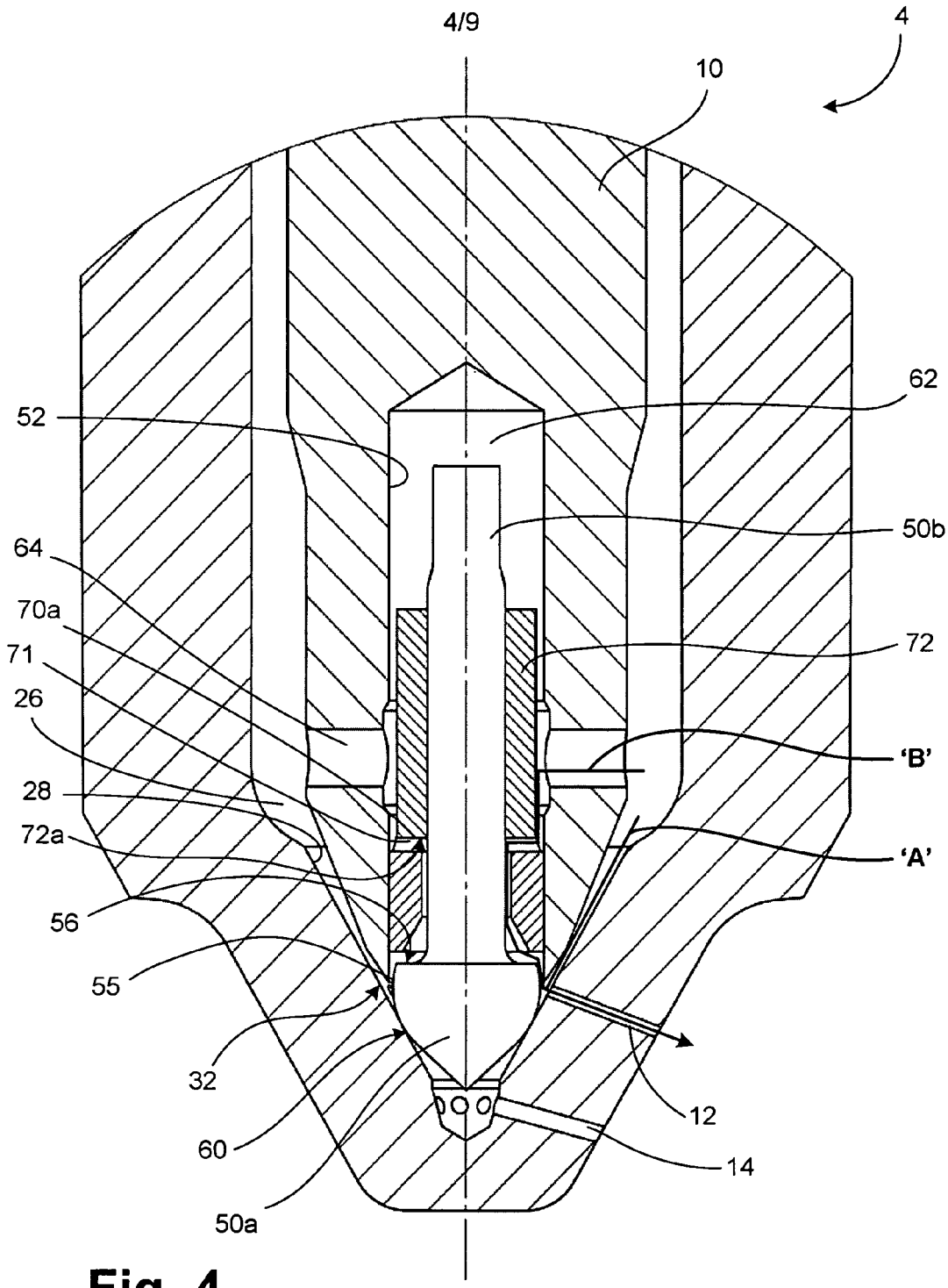
FIG. 4 is a part-sectional view of the injection nozzle in FIGS. 2 and 3 when in a first injecting position.

Referring to FIG. 4, in order to inject fuel through the first (upper) outlets 12 only, the stack is de-energised to a first, intermediate energisation level causing it to contract, resulting in a lifting force being transmitted to the outer valve needle 10. The outer valve needle 10 is thus urged to move away from its internal and external seatings 56, 32 to open a fuel flow path 'A' past the external seating 32 and, thus, through the first outlets 12. It will be appreciated that the flow path 'A' to the outlets 12 which is opened as the outer valve needle 10 lifts from the external seating 32 is an annular flow path around the outer valve needle 10, although in the section shown it is denoted by a single arrow.

In addition to the first fuel flow path 'A', a second fuel flow path 'B' is created as the lower surface 70*b* of the ring 70 disengages the internal seating 56. Fuel flows along flow path 'B' from the delivery chamber 26, through the radial drillings 64 and through the channels 71 provided in the upper face 70*a* of the ring 70 into the annular gap defined between the ring 70 and the stem region 50*b*. Since the ring 70 is disengaged from the internal seating 56, fuel flows through the annular gap past the seating 56, through the annular gap 55 between the opening of the outer valve bore 52 and to the first outlets 12.

During this initial de-energisation of the stack 42, the outer valve needle 10 is caused to move through a distance less than or equal to the distance 'L' (identified on FIG. 3). The ring 70 is carried with the outer valve needle 10 so that the upper end face 70*a* of the ring 70 approaches the opposing lower end face 72*a* of the sleeve 72. In FIG. 4, the ring 70 is moved exactly through the distance 'L' so that it just makes contact with the sleeve 72. Provided the distance through which the outer valve needle 10 moves is no greater than the pre-determined distance 'L', movement of the inner valve needle 50 remains decoupled from the outer valve needle 10, thus the inner valve needle 50 will remain firmly seated against the inner valve seating 60 under the influence of pressurised fuel within the chamber 62. Fuel is therefore unable to flow past the seated part-spherical head 50*a* of the inner valve needle 50 to the second outlets 14.

The above described condition represents fuel injection optimised for relatively low power applications since a relatively small volume of fuel is injected through the first set of relatively small outlets 12 only.

If, at this point, it is necessary to terminate injection through the first outlets 12, the stack 42 is re-energised to its initial energisation level causing the stack 42 to extend. As a result, the outer valve needle 10 is caused to re-engage both with the external seating 32, defined by the conical seating surface 28, and the internal seating 56, defined by the part-spherical head 50*a*, under the influence of the biasing force of the closing spring 45 (shown in FIG. 1).

Figure 5:
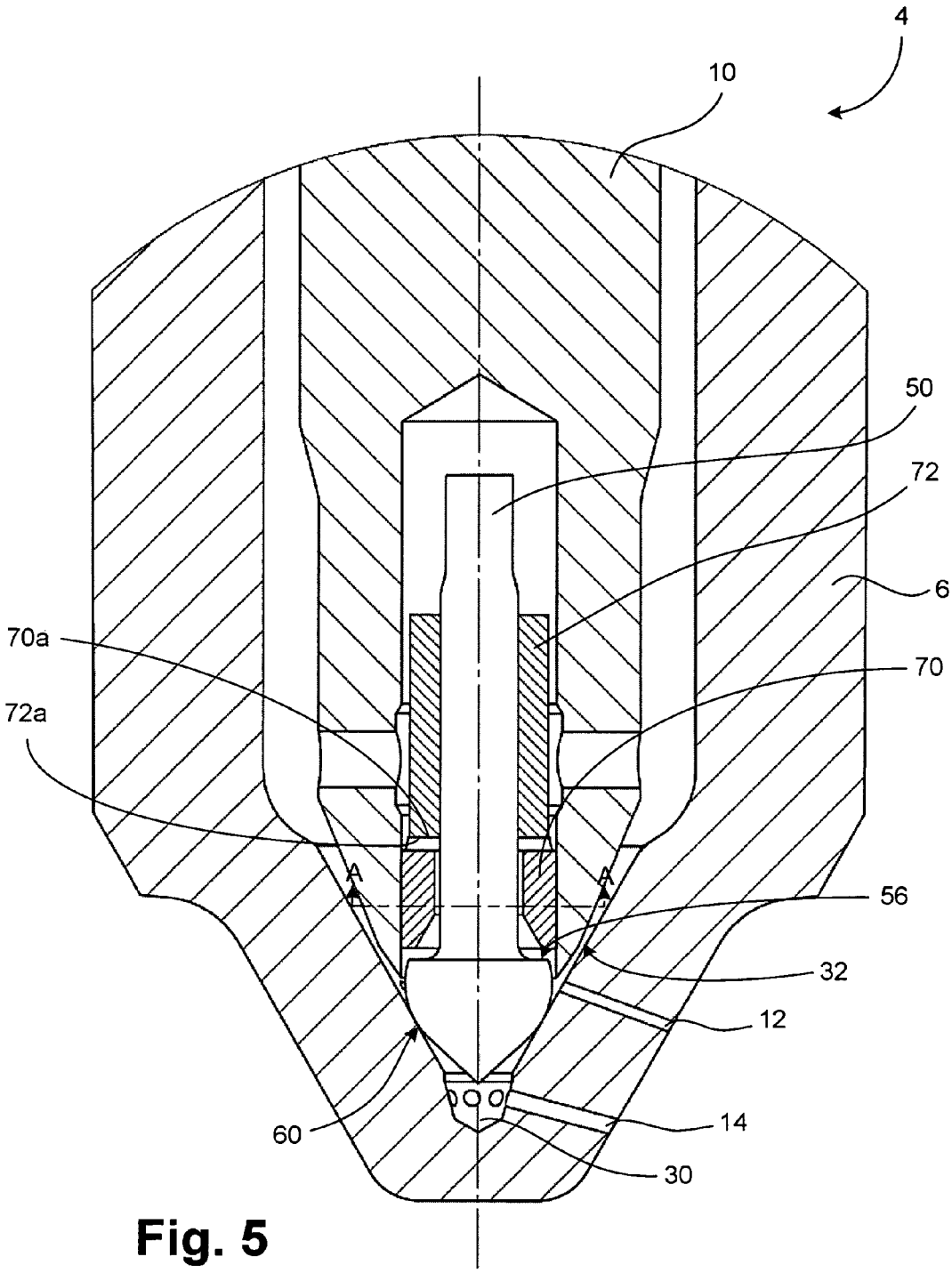
FIG. 5 is a part-sectional view of the injection nozzle in FIG. 2 when in a second injecting position.

FIG. 5 shows the injection nozzle during a subsequent, or alternative, stage of injector operation in which the stack 42 may be de-energised further to a second energisation level causing the stack length to be reduced further. As a result, the outer valve needle 10 is urged away from the internal and external seatings 56, 32 by a further amount, which is greater than the predetermined distance 'L'. In such circumstances, the upper end face 70*a* of the ring 70 is caused to engage the lower end face 72*a* of the sleeve 72, thereby causing movement of the outer valve needle 10 to be conveyed or coupled to the inner valve needle 50. As a result, the inner valve needle 50 is caused to lift from the inner valve seating 60.

As the inner valve needle 50 lifts away from the inner valve seating 60, fuel within the delivery chamber 26 is able to flow past the internal and external seatings 56, 32 to the first outlets 12, but also past the inner valve seating 60 to the second (i.e. lower) outlets 14 and into the combustion chamber via the sac volume 30. The flow through the second outlets 14 supplements the fuel flow through the first outlets 12 to provide a higher fuel injection rate suitable for higher engine power modes.

Termination of injection occurs if the stack 42 is energised once again to the higher energisation level, as described previously. Alternatively, the energised level may be increased slightly to the first level so that only the outer valve needle 10 is lifted and the inner valve needle 50 returns to the inner valve seating 60 so as to close the flow path to the second outlets 14.

A particular benefit of the nozzle described previously is that the second flow path 'B' improves the flow efficiency of the injection nozzle 4 since there is a greater flow area for fuel for a given level of lift of the outer valve needle 10 compared to conventional VONs. In addition, the second flow path 'B' serves to reduce the pressure drop between positions upstream and downstream of the seats, 32, 56, 60 such that lateral side loads acting on the outer valve needle 10 are also reduced.

Figure 6:
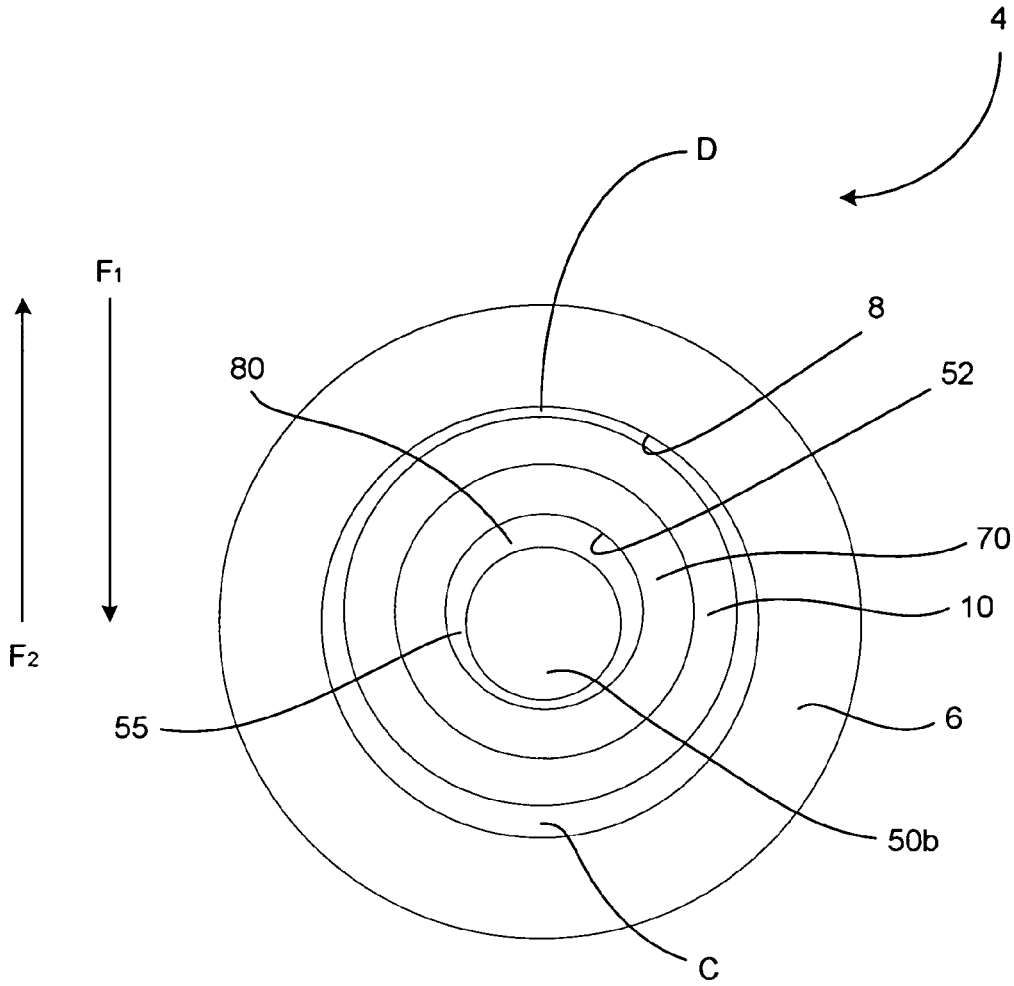
FIG. 6 is a sectional view of the injection nozzle in FIG. 5 along the line A-A during circumstances in which the outer valve needle lifts eccentrically.

Furthermore, the above described arrangement has the effect of substantially balancing the side loads on the outer valve needle 10. By way of explanation, FIG. 6 depicts a scenario in which the outer valve needle 10 has lifted away from the external seating 32 in an eccentric manner such that the clearance between the nozzle body bore 8 and the outer valve needle 10 at a first region 'C' is greater than a diametrically opposite region 'D'. It will be appreciated that the scale of the components and the clearances in FIG. 6 are exaggerated for the sake of clarity. Fuel flowing through the regions C and D therefore generate a side load in the direction of F1. However, since the part-spherical head 50*a* remains seated during relatively low needle lifts, the fuel flowing through the annular gap 80 (second fuel flow path 'B') between the stem region 50*b* and the outer valve bore 52 generates a side load in the direction of F2 which opposes F1, and thus provides a balancing force. Therefore, the net side force acting on the outer valve needle 10 is substantially educed which reduces the tendency of the outer valve needle 10 to lift eccentrically.

A further benefit is achieved as the outer valve needle 10 seats against a component (the inner valve needle 50) which has a part-spherical surface in engagement with the inner valve seating 60. The part-spherical nature of the inner valve needle 50 allows it to rotate, or tilt, about the centre of its sphere to correct any misalignment of the internal seating 56 on its upper face. As the centre of the part-spherical head 50*a* is paced only a short distance from the internal seating 56 (i.e. a 'flat top' of the part-spherical head 50*a*), any torque on the inner valve needle 50 arising from friction at the seating 56, which would otherwise resist the realignment, is minimal. As the internal seating 56 is defined by the upper surface of the part-spherical head 50*a*, this also means that the external seating 32 and the internal seating 56 can be approximately aligned along the longitudinal axis of the injection nozzle 4 when the outer valve needle 10 is seated, and only axially spaced by a relatively small amount (at most, by the predetermined lift distance L), when the outer valve needle 10 is lifted.

Figure 7:
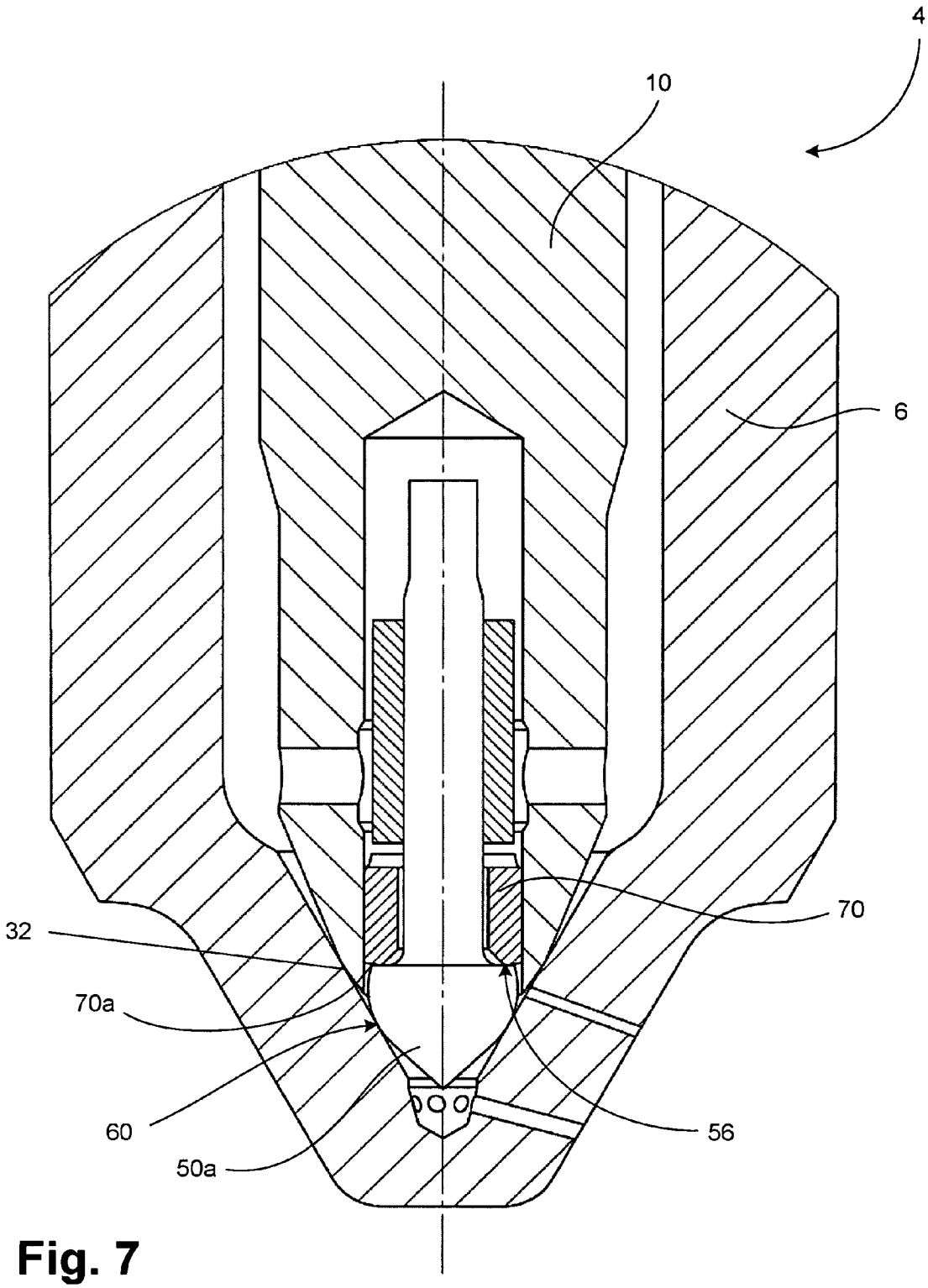
FIG. 7 is an enlarged part-sectional view of an injection nozzle according to a second embodiment of the present invention when in a non-injecting position.

FIG. 7 shows a second embodiment of the invention, whereby instead of the lower face 70*a* of the ring 70 being flat, it is inclined at an angle to the horizontal (i.e. the lower face 70*a* is frusto-conical) in order to generate a distinct annular seating line 56 against the flat upper face of the part-spherical head 50*a*. Concentrating the seating 56 to a distinct annular line, rather than a face to face contact, is likely to give an improved seal which is more tolerant of flatness errors and less likely to trap dirt. It will be appreciated that it is also possible for the part-spherical head 50*a* to be manufactured with an inclined surface and the lower surface 70*a* of the ring 70 to be flat. However, this variant may be more challenging to manufacture since a frusto-conical surface would be more susceptible to concentricity errors.

At higher lifts, as the outer valve needle 10 is lifted further away from its internal and external seatings 56, 32, the effective location of the internal seat restriction will move towards the periphery of the outer valve bore 52 as the clearance between the part-spherical head 50*a* and the outer valve bore 52 becomes more restrictive than that at the internal seating 56. That is to say, as the outer valve needle 10 is lifted higher the fuel flow is most restricted through the channel formed between the peripheral surface of the part-spherical head 50*a* and the inner surface of the outer valve bore 52, as this channel becomes smaller relative to the spacing between the lower end face 70*a* of the ring 70 and the internal seating 56.

Operation of the injection nozzle 4 in FIG. 7 would be implemented in a similar manner as for FIGS. 2 to 5.

Figure 8:
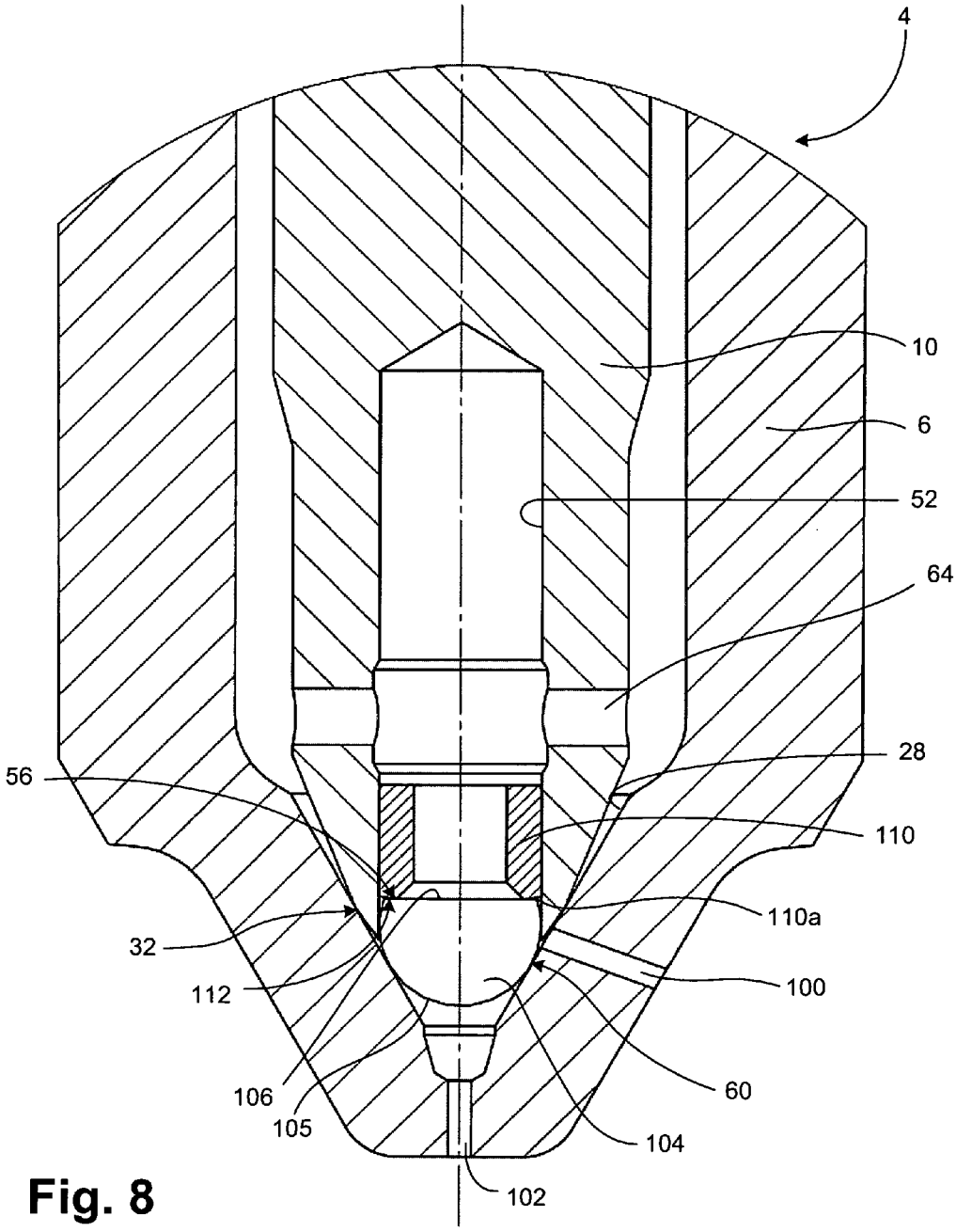
FIG. 8 is an enlarged part-sectional view of an injection nozzle according to a third embodiment of the present invention when in a non-injecting position.
Figure 9:
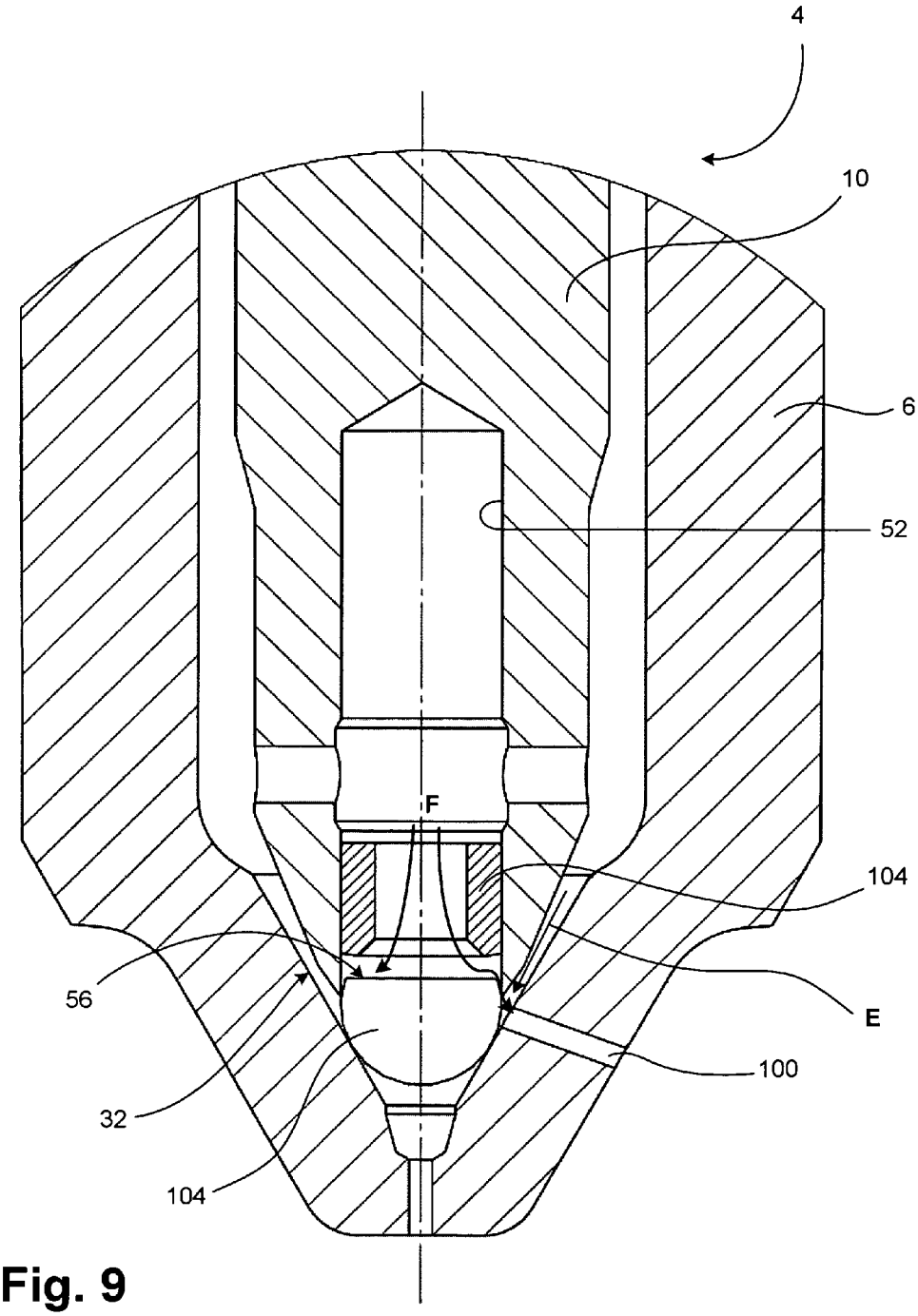
FIG. 9 is a part-sectional view of the injection nozzle in FIG. 8 when in a first injecting position.

FIGS. 8 and 9 illustrate a third embodiment of the present invention. This embodiment is broadly similar to the above-described embodiments and like parts will be numbered accordingly and not described again here.

The third embodiment differs in that the nozzle body 4 is provided with only a single set of outlets 100 to the combustion chamber, but is however provided with an additional axially extending outlet or vent 102, the function of which will be described later. A further modification is that the inner valve needle 50 is replaced with a substantially immovable part-spherical insert 104 having a part-spherical external surface 105 and a flat, upper surface 106. The part-spherical surface 105 seats on the insert seating 60 and is received within the lowermost end opening of the outer valve bore 52.

In this embodiment, the bore 52 in the outer valve needle 10 includes a ring 110 having a frusto-conical lower face 110*a* similar to that shown in FIG. 7, although a ring 110 having a flat lower face could equally be used. The frusto-conical lower surface 110*a* thus defines an internal annular seating line 112 for the outer valve needle 10. When the nozzle 4 is in the non-injecting position, the ring 110 seats against the internal seating 56 defined by the insert 104.

The diameter of the outer periphery of the insert 104 is less than the diameter of the outer valve bore 52 such that a restricted annular flow path is defined between the periphery of the insert 104 and the inner surface of the outer valve bore 52. The dimension of the gap is selected as a compromise between providing sufficient centring force to the outer valve needle 10 and providing sufficient fuel flow through the gap.

In the event that the ring 110 is slightly misaligned in the outer valve bore 52, the insert 104 can adjust its seating angle on the insert seating 60 by rotating, or tilting, about the centre of its sphere, so that its flat upper face 106 can adopt the angle of the ring 110 and, hence, account for the misalignment. The set of nozzle outlets 100 is therefore sealed effectively from high pressure fuel at both the external and internal seatings 32, 56 of the outer valve needle 10.

High pressure fuel enters the outer valve bore 52 via the radial drillings 64 and, together with the force of the spring 45 (not shown in FIG. 8), which is transmitted to the part-spherical insert 104 via the ring 110, serves to hold the insert 104 in place against the insert seating 60. The axial outlet 102 in the nozzle body 6 provides a vent underneath the insert 104 to ensure that any fuel leaking past the insert seating 60 into the tip of the nozzle body 6 simply vents into the combustion chamber. In this way, the insert 104 is prevented from lifting from the insert seating 60 because of fuel trapped beneath it.

Referring to FIG. 9, when it is desired to inject fuel through the outlets 100, the outer valve needle 10 is retracted by means of the piezoelectric stack 42 (not identified in FIG. 9) causing the ring 104 to disengage from the internal seating 56. In such circumstances, a first annular flow path 'E' opens up past the external seating 32 and a second annular flow path 'F' opens up past the internal seating 56 so that high pressure fuel can flow out through the outlets 100 into the combustion chamber.

As the part-spherical insert 104 is effectively rooted to the inner seating 60 by virtue of the high pressure fuel in the outer valve bore 52, fuel is unable to flow past the insert seating 60 to the outlet 102.

A method by which the inner and outer valves members 50, 10 according to the first embodiment may be assembled within the nozzle body 6 will now be described, with general reference to the aforementioned FIGS. 1 to 7 and the reference numerals indicated therein.

Initially, the ring 70 is caused to receive the stem region 50*b* of the inner valve needle 50 so that the lower face 70*b* of the ring 70 abuts the internal seating 56 defined by the part-spherical head 50*a*. With the ring 70 in position, the stem region 50*b* is received in the sleeve 72 such that the ring 70 is retained on the inner valve needle 50.

In order to set the predetermined distance 'L', a spacer tool, such as a shim of thickness 'L' (not shown), is positioned against the upper end face 70*a* of the ring 70, whereby the sleeve 72 is pushed so as to engage the shim. When the shim is removed, the necessary separation of distance 'L' is established between the upper end face 70*a* of the ring 70 and the lower end face 72*a* of the sleeve 72.

Following assembly of the inner valve needle 50, the ring 70 and the sleeve 72, the combined inner valve and ring/sleeve assembly is pushed into the bore 52 of the outer valve needle 10. The inner and outer valves needles 50, 10 are then together inserted into the nozzle body bore 8 such that the outer valve needle 10 engages with its internal and external seatings 56, 32 and the inner valve needle 50 engages the inner valve seating 60. Following assembly of the nozzle 4, a seat bedding operation is performed in order to establish effective seals at the seatings of the inner and outer valve needles 50, 10, respectively. The seat bedding operation comprises applying a constant predetermined axial force to the outer valve needle 10, which causes it to "bed in" over the external seating 32. As an alternative to applying a predetermined constant axial force to the outer valve needle 10, the bedding in operation could also be dynamic.

Regarding the manufacture of the embodiment in FIGS. 8 and 9, to ensure that the outer valve needle 10 contacts with both internal and external seatings 56, 32 simultaneously to provide an effective seal for the outlets 100, the ring 110 is pushed into its final position by assembling all the components within the nozzle body 6 and applying a load to the outer valve needle 10 until a seal is formed such that fluid ceases to issue from the outlets 100. Alternatively, the outer valve needle 10 could be pushed into the bore until it makes contact with its seating with a predetermined force. It will be appreciated that the above method could also be employed during the manufacture of the first embodiment.

It will be understood by those who practice the invention and those skilled in the art, that various modifications and improvements may be made to the invention without departing from the scope of the invention, as defined by the claims. For example, in the first, second and third embodiments the inner valve needle 50 is forced into engagement with its seating 60 by the high pressure fuel in the outer valve bore 52 and the ring 70 in abutment with the part-spherical head 50*a*. However, it is possible that, in use, the lower end face 70*a* of the ring 70 may wear such that a clearance develops at the seating 60 even when the inner and outer valve needle 50, 10 are seated, so compromising the seal established by the inner valve needle 50 on the nozzle body 6. To address this, it may be desirable to provide a resilient member such as a helical spring (not shown) within the chamber 62 to provide a further biasing force to the inner valve needle 50. Such a spring may abut against an upper end face of the sleeve 72 such that the biasing force is transmitted to the inner valve needle 50 via the frictional coupling between these parts. Alternatively the spring may abut a separate abutment member located within the chamber 62.

Furthermore, although the ring 70 and the sleeve 72 are coupled to the outer valve needle 10 and inner valve needle 50, respectively, through frictional contact, it will be appreciated that coupling may be achieved through alternative arrangement, for example by gluing or soldering.

In addition, although the vent 102 in the embodiment described with reference to FIGS. 8 and 9 is axially disposed, it should be appreciated that this need not be the case. For example, the vent 102 may be parallel with the outlets 100 or at an angle to the central axis of the nozzle body 6.

It should be understood that although the injection nozzle of the present invention has been described as suitable for use within an injector having a piezoelectric actuator, it is entirely possible that the injector may include an alternative form of actuator for moving the valve(s). For example, instead of a piezoelectric actuator, the outer valve may be moved by means of an electromagnetic actuator.

Although the nozzle body 6 has been described as defining the external seating 32 and the insert seating 60 for the outer valve needle 10 and the inner valve needle 50, respectively, the nozzle body 6 may be provided with a lining plate, sleeve or similar so as to define these surfaces. Similarly, the ring 70 could be provided with a covering plate over its lower end face 70*a* to define that surface of the outer valve needle 10 that engages with the internal seating 56. Also, either the inner valve needle 50 or the insert 104 could be provided with covering plates or similar so as to define the internal seating 56. In another modification, the outer valve bore 52 may be provided with a lining sleeve, or similar component, so as to define the internal bore surface.

In an alternative embodiment, the inner valve needle 50 may be constructed differently so that the ring 70 forms an integral part of the outer valve needle 10.

The invention claimed is:

1. The injection nozzle being such that the outer valve member disengages with the external seating at the same time as it disengages with the internal seating, while the insert remains seated on the seating surface, a nozzle body defining a seating surface and having a first nozzle outlet;

an outer valve member received within the nozzle body and being engageable with an external seating defined by the seating surface so as to control fuel injection through the first nozzle outlet, the outer valve member defining a blind axial bore having an internal bore surface, the outer valve member defining a passage allowing continuous fluid communication between the bore and the exterior of the outer valve member; and an insert received within the bore, the insert defining an annular gap with the internal bore surface, wherein the outer valve member is engageable with an internal seating defined by a surface of the insert to control fuel flow through the annular gap to the first nozzle outlet, the injection nozzle being such that the outer valve member is arranged to disengage with the external seating at the same time as it disengages with the internal seating such that the fuel which is to be ejected from the nozzle is always caused to flow simultaneously along: (a) a first path between the outer valve member and the external seating; and (b) a second path through the annular gap.

2. The injection nozzle according to claim 1, wherein the insert includes a part-spherical head which spans the internal diameter of the bore to define the annular gap.

3. The injection nozzle according to claim 2, wherein the internal seating is defined by a surface of the part-spherical head.

4. The injection nozzle according to claim 3, wherein the part-spherical head is engaged with an insert seating defined by the seating surface during at least a period of nozzle operation.

5. The injection nozzle according to claim 4, further comprising a second nozzle outlet provided in the nozzle body, wherein the insert is an inner valve member which is slidable within the bore and engageable with the insert seating so as to control fuel injection through the second outlet.

6. The injection nozzle according to claim 5, wherein the outer valve member includes an annular member which is received within the bore so as to be engageable with the internal seating.

7. The injection nozzle according to claim 6, further comprising a sleeve member coupled to the inner valve member, wherein the annular member is brought into engagement with the sleeve member when the outer valve member is moved axially through a distance that is greater than a predetermined distance so as to impart axial movement to the inner valve member also.

8. The injection nozzle (4) according to claim 7, wherein the annular member and the sleeve member have opposed end faces which are spaced apart by the predetermined distance when the outer valve member and the inner valve member are seated against their respective seatings.

9. The injection nozzle according to claim 8, wherein an end face of the annular member that engages the internal seating is substantially flat.

10. The injection nozzle according to claim 8, wherein an end face of the annular member that engages the internal seating is frusto-conical.

11. The injection nozzle according to claim 5, wherein the inner valve member includes a valve stem, and wherein the internal seating is defined by a shoulder defined between the part-spherical head and the valve stem.

12. The injection nozzle according to claim 4, wherein the insert remains engaged with the insert seating during all stages of nozzle operation.

13. The injection nozzle according to claim 12, wherein the outer valve member includes an annular member which is received within the bore so as to be engageable with the internal seating.

14. The injection nozzle according to claim 12, wherein the nozzle body is provided with a vent passage through which fuel can escape in the event of fuel leakage past the insert seating.

15. The injection nozzle according to claim 4, further comprising an arrangement for urging the insert against the insert seating.

16. The injection nozzle according to claim 15, wherein the arrangement for urging the insert against the insert seating includes the passage formed in the outer valve member which enables fuel to enter the bore, thereby to apply a hydraulic closing force to the insert.

17. The injection nozzle according to claim 15, wherein the arrangement for urging the insert against the insert seating includes a spring.

18. The injection nozzle according to claim 1, wherein the first path is provided past the external seating to the first outlet, and the second path is further provided to the first outlet past the internal seating when the outer valve member is unseated.

19. The injection nozzle according to claim 1, wherein the external seating and the internal seating are positioned along the axis of the nozzle body in approximate alignment at least when the outer valve member is seated.

20. An injector for use in an internal combustion engine, wherein the injector includes an injection nozzle as claimed in claim 1 and an actuator for operating the injection nozzle.

21. The injector according to claim 20, wherein the actuator is a piezoelectric actuator.

* * * * *